US008827668B2

(12) United States Patent
Giuseppe

(10) Patent No.: US 8,827,668 B2
(45) Date of Patent: Sep. 9, 2014

(54) TOOTH PROFILE FOR ROTORS OF POSITIVE DISPLACEMENT EXTERNAL GEAR PUMPS

(75) Inventor: Catania Giuseppe, Bologna (IT)

(73) Assignee: Marzocchi Pompe S.p.A., Casalecchio Reno (IT)

( * ) Notice: Subject to any disclaimer, the term of this patent is extended or adjusted under 35 U.S.C. 154(b) by 781 days.

(21) Appl. No.: 12/998,705

(22) PCT Filed: Dec. 1, 2009

(86) PCT No.: PCT/EP2009/066127

§ 371 (c)(1),
(2), (4) Date: May 20, 2011

(87) PCT Pub. No.: WO2010/063705

PCT Pub. Date: Jun. 10, 2010

(65) Prior Publication Data

US 2011/0223051 A1 Sep. 15, 2011

(30) Foreign Application Priority Data

Dec. 2, 2008 (IT) ..... MC2008A0213
Oct. 30, 2009 (IT) ..... MC2009A0225

(51) Int. Cl.

| | |
|---|---|
| ***F01C 21/00*** | (2006.01) |
| ***F01C 1/16*** | (2006.01) |
| ***F01C 1/18*** | (2006.01) |
| ***F04C 2/08*** | (2006.01) |
| ***F04C 2/16*** | (2006.01) |

(52) U.S. Cl.
CPC .. *F04C 2/084* (2013.01); *F04C 2/16* (2013.01)
USPC ..... 418/150; 418/206.1; 418/206.5; 418/201.3

(58) Field of Classification Search
CPC ..... F04C 2/082; F04C 2/084
USPC ..... 418/150, 206.5, 206.1, 201.3
See application file for complete search history.

(56) References Cited

U.S. PATENT DOCUMENTS

| | | | | |
|---|---|---|---|---|
| 2,159,744 | A | 5/1939 | Maglott | 103/128 |
| 2,462,924 | A | 3/1949 | Ungar | 74/466 |
| 3,164,099 | A | 1/1965 | Iyoi | 103/128 |
| 3,209,611 | A | 10/1965 | Iyoi | 74/462 |

FOREIGN PATENT DOCUMENTS

| | | |
|---|---|---|
| GB | 827617 | 2/1960 |

*Primary Examiner* — Theresa Trieu
*Assistant Examiner* — Anthony Ayala Delgado
(74) *Attorney, Agent, or Firm* — Lowe Hauptman & Ham, LLP

(57) ABSTRACT

The present invention deals with the analytical definition of a tooth profile for rotors used in gear pumps. The purpose is to obtain a pump characterized by noiseless operation, minimization of vibrations and pressure overoscillations generated in operating conditions at the beginning and end of life, and high specific displacement, in such a way to increase the delivery of the pump in given volume conditions. This profile is characterized by an active profile of the tooth flanks with involute stub-tooth with transverse contact ratio ($\epsilon_t$) comprised in the range from 0.4 to 0.45, helical teeth with helical contact ratio ($\epsilon_\beta$) comprised in the range from 0.6 to 0.85, circular inactive tooth bottom and top profiles, with center ($O_f$, $O_t$) and radius ($r_f$, $r_t$) defined by a non-dimensional parameter $\zeta$ in the range from 1.1 to 1.6.

4 Claims, 19 Drawing Sheets

($z$=4; $\varepsilon_t$= 0.4; $\zeta$=5; $\alpha_t$=35°)

($z=4$; $\varepsilon_t = 0.4$; $\zeta=5$; $\alpha_t=35°$)

($z$=7, $\varepsilon_t$=0.4, $\zeta$=20; $\alpha_t$=35°)

($z$=7, $\varepsilon_t$=0.4, $\zeta$=5; $\alpha_t$=35°)

($z$=7; $\varepsilon_f$=0.4; $\zeta$=1.25; $\alpha_f$=35°)

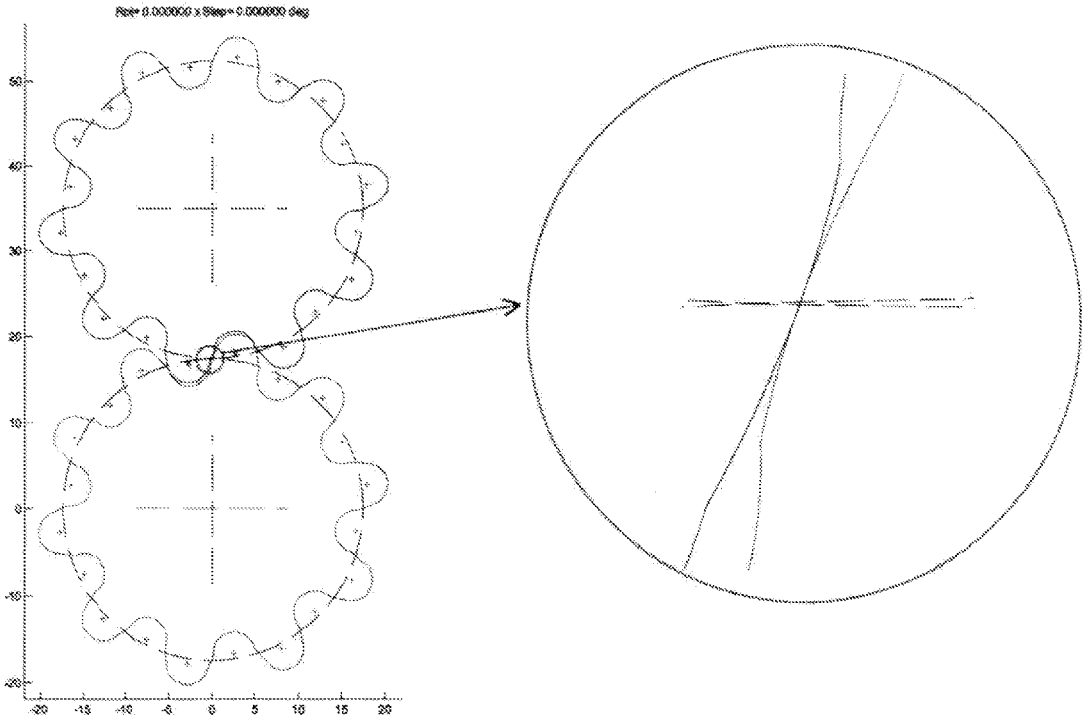
Fig. 15a: Maglott profile - θ= 0

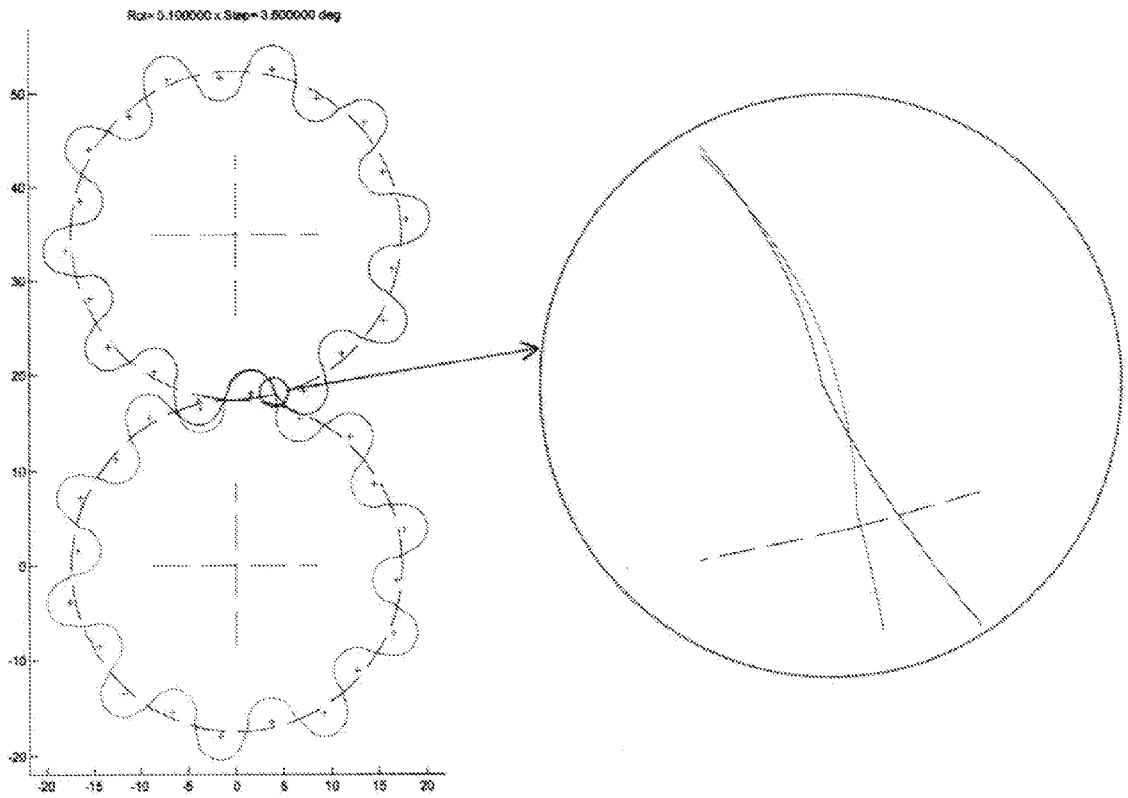
Fig. 15b: Maglott profile - $\theta = 0.1*2\pi/z$

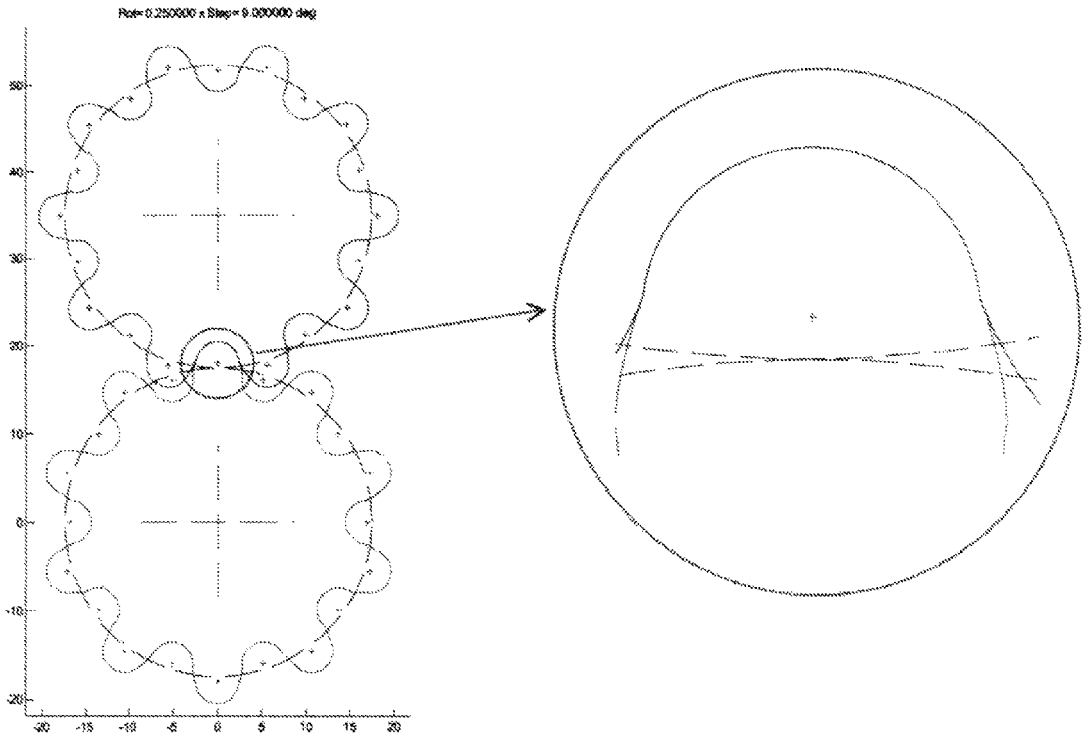
Fig. 15c: Maglott profile - $\theta = 0.25*2\pi/z$

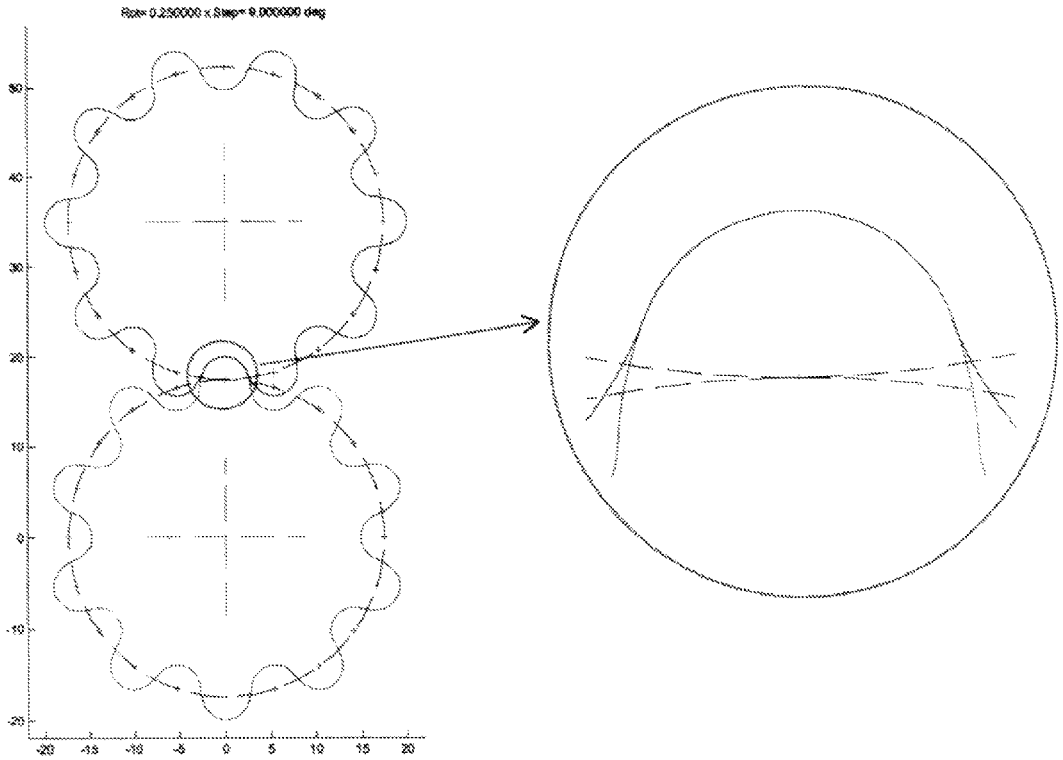
Fig. 16: Hitosi profile - $\theta = 0.25*2\pi/z$

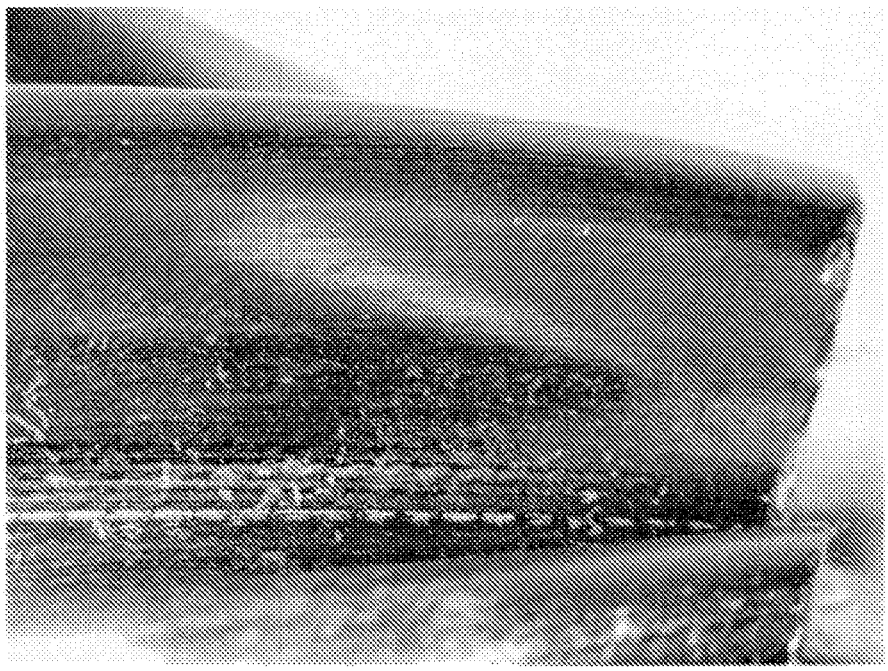
Fig.17a: Surface wear in Maglott rotor
Ra= 6.4 * $10^{-3}$ mm
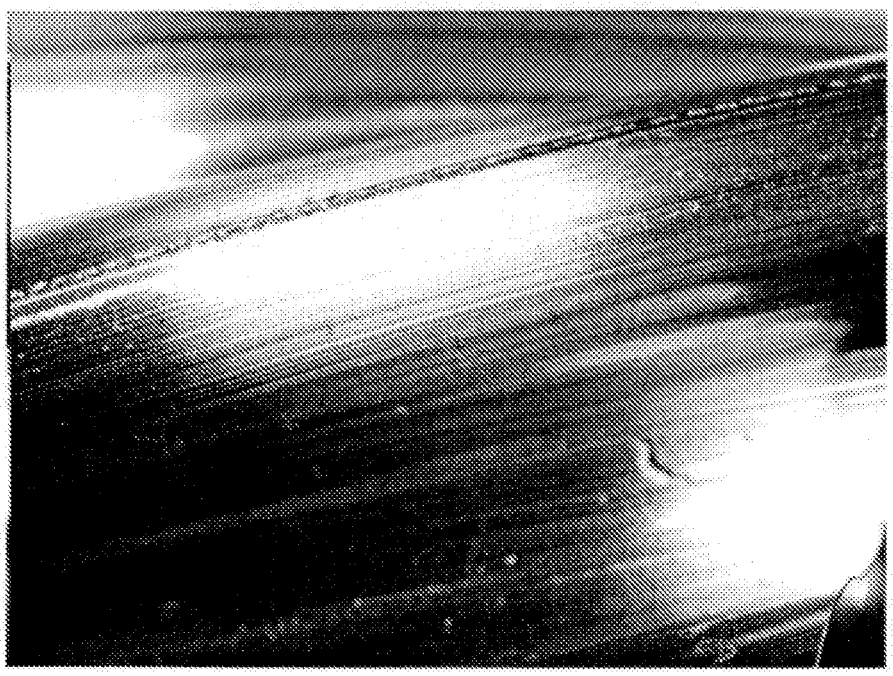
Fig.17b: Surface wear in Hitosi rotor
Ra= 5.2 * $10^{-3}$ mm

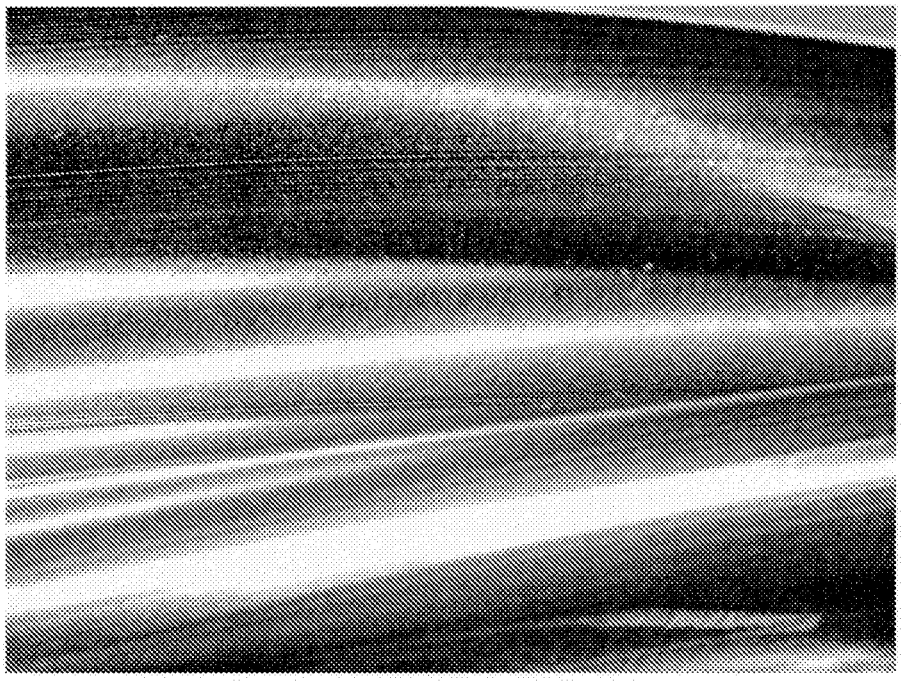
Fig.17c: Surface wear in Invention rotor
$Ra = 0.6 * 10^{-3}$ mm

TOOTH PROFILE FOR ROTORS OF POSITIVE DISPLACEMENT EXTERNAL GEAR PUMPS

The present patent application for industrial invention relates to a tooth profile for rotors of positive displacement external gear pumps. In particular, the present invention relates to noiseless positive displacement gear pumps characterised by high efficiency and specific high displacement.

Gear pumps are devices that are normally used in many industrial sectors, such as the automotive, earth moving machines, automation and control sectors. Referring to FIG. 1, a gear pump generally comprises two rotors with intermeshing teeth. The rotors are arranged inside a casing so that a fluid suction area and a fluid discharge area are defined. One of the two rotors is driven by a drive shaft.

Gear pumps are positive displacement pumps since the volume comprised between the spaces of the teeth of the two intermeshing rotors and the external casing can be displaced from the inlet to the discharge area. The fluid type, the discharge and inlet pressures and the delivery associated with the pump can vary with respect to the particular application. However, in most common applications and, in particular, in the application referred to in the present invention, the fluid is partially uncompressible oil, whereas the reference pressure values are typically the inlet ambient pressure and the discharge pressure with maximum typical levels of 300 bar.

Delivery is variable and depends on pump displacement, and consequently on the gear size, as well as on the maximum rotational speed n of the rotors, typical values being n=1000÷4000 rpm.

The gear is composed of two toothed wheels with external straight or helical teeth, with the same size and unitary gear ratio. The total efficiency associated with this device typically varies in the range $\eta$=70%-90%, according to the geometry of the gear (volumetric efficiency), to the mechanical losses of the couplings (mechanical efficiency) and to the operating conditions. FIG. 1 shows a typical constructive example of said device.

The most significant parameters that characterise the performance of these devices include the pump noise level in rated operating conditions, the pressure ripple generated in inlet and discharge in rated operating conditions, the volumetric efficiency, the total efficiency, and the displacement (or volume displaced per cycle) of the pump.

Referring to FIG. 2, in typical applications of said device the toothed profile is defined by an involute profile in the active section (right-handed tooth flank and left-handed tooth flank), and circular profiles in the tooth top and bottom joined to the active side profiles. The centre of the tooth top and bottom circular profiles coincides with the centre of rotation of the toothed wheel.

According to the various international standards (i.e. ISO; DIN, UNI, AGMA), in the tooth top and bottom profile that is commonly adopted, standardised and normally used in the majority of toothed profiles of gears in different situations other than positive displacement pumps, the section of the tooth on the top does not coincide with the section of the tooth bottom space in the same reference conditions, in order to ensure that contact occurs exclusively in the involute profile section.

The choice of involute profiles guarantees that the gear meshing profiles are conjugate profiles and the gear velocity ratio is kept constant in each intermeshing configuration; this choice also allows for correct operation in the event of slight variations of the theoretical gear center distance due to constructive or assembly requirements.

The disadvantages arising from the use of these profiles in external spur gears are known and disclosed in numerous technical publications (Henriot, *Traité théorique et pratique des engrenages*, Dunod; 1977, vol. II) and patents (U.S. Pat. No. 2,159,744 (Maglott); U.S. Pat. No. 3,164,099 (Hitoshi) and U.S. Pat. No. 3,209,611(Hitoshi)). These disadvantages can be summarised as follows:

1) As shown in FIG. 3, the volume trapped during meshing on the discharge side, isolated and then reduced during the kinematic configurations following the first contact, determines fluid compression, generating high overpressure, operating noise and negative back flow delivery from discharge to suction, thus reducing the pump displacement and the total efficiency.

2) If z is the number of teeth of each rotor, the fluid delivery guaranteed at discharge is discontinuous, because of the discontinuous delivery transfer of 2*z volumes comprised between the spaces of the teeth and the external casing, such discontinuity generating pressure oscillations.

3) The displacement of the pump, and consequently the total delivery, are limited, with the same pump volume, by the value of the minimum number of gear teeth $z_{min}$: the condition of cutting and operating non-interference results in $z>z_{min}$=10-11, the $z_{min}$ value being dependent on the different construction and design technologies (profile correction) employed, as indicated in Dudley's Gear handbook, McGraw-Hill, 1992.

Many technical solutions have been proposed to solve the aforesaid problems.

One known architecture employs the so-called "lobe" profiles, with non-conjugate profiles that are not suitable for motion transmission. Motion transmission is generally provided by an additional pair of toothed wheels with traditional teeth, unitary gear ratio and made on the same axes as the lobe wheels, in order to guarantee continuous motion transmission. This architecture has very high realisation costs and a very high axial volume, making it not compatible with market requirements.

Other architectures adopt helical teeth instead of spur teeth: with the adoption of a helical or face contact ratio $\epsilon_\beta$ close to 1, pressure oscillations due to discontinuity of the fluid delivery can thus be reduced. Examples of this solution are illustrated in Henriot, *Traité théorique et pratique des engrenages*, Dunod; 1977, vol. II and F. Masi, *Manuale di Cinematica applicata*, Zanichelli, Bologna, 1890.

However, the problems related to pressure ripple, noise and negative delivery have not yet been solved, whereas in general the problems related to displacement can be solved by using stub-tooth profiles characterised by a very low profile contact ratio, as in the example illustrated in *Prontuario dell'ingegnere* 1999, Hoepli, page 440, which illustrates a gear with helical teeth z=7.

The helical gear solution exhibits other problems, such as high manufacturing costs and low insulation between discharge and inlet chambers, virtually in direct communication if face width and the number of teeth are reduced. In addition, the helical gear solution is associated with the transmission of axial force components, which are higher in the case of a high helix angle, generally requiring a modification of the pump casing and the adoption of suitable manufacturing solutions to guarantee the balance of the axial thrust, such as for example the architectures illustrated in U.S. Pat. No. 3,658,452 (Yasuo Kita) and in Italian patent no. 1.124.357 in the name of the same applicant.

The solution proposed in U.S. Pat. No. 2,159,744 (Maglott) adopts an involute stub-tooth profile, with transverse contact ratio $\epsilon_t$=0.5 and helical teeth with helical contact ratio $\epsilon_\beta$=0.5 in such a way that the total contact ratio is $\epsilon=\epsilon_t+\epsilon_\beta=1$ and motion continuity is guaranteed. This solution reduces the pressure oscillations related to delivery discontinuity, and in general, although not expressly indicated, the $\epsilon_1$=0.5 choice makes it possible to decrease the minimum value of $z_{min}$ teeth to lower values ($z_{min}$<6 according to the transverse pressure angle $\alpha_t$ of the involute profile). The value of $\epsilon_t$=0.5 also solves the problems related to pressure ripple and noise since no fluid volume is trapped or closed in this case.

Maglott also proposes connecting the involute stub-tooth profiles of the tooth flanks with circular profiles having their centre respectively in the upper and lower position with respect to the pitch circle for tooth top and bottom profiles. This allows minimisation of the fluid negative delivery from discharge to suction, therefore increasing the volumetric efficiency of the device. However, no indication is given as regards:

- the displacement of the centre of the circular tooth top and bottom profiles from the pitch circles,
- the ideal value of the pressure angle of the active involute profile,
- the number of teeth, and
- any solutions suitable for balancing axial thrusts.

The solution proposed by U.S. Pat. No. 3,164,099 (Hitosi) mainly differs from the solution proposed by Maglott due to the adoption of helical teeth with helical contact ratio $\epsilon_\beta$=1.0, in such a way that the total contact ratio is $\epsilon=\epsilon_t+\epsilon_\beta=1.5$, maintaining the transverse contact ratio of the involute $\epsilon_t$=0,5. Continuity is fully guaranteed by the helical contact ratio alone.

This choice eliminates the torque oscillations transmitted by the gear in uniform operating conditions. However, the axial stress components are higher and the insulation conditions between the inlet and discharge chambers can not be guaranteed. The profile used for the analytical definition of the tooth flank is an involute profile with $\epsilon_t$=0.5, as in Maglott, although the use of other profiles is described (cycloidal; arbitrary profile connecting two extreme points defined by the involute profile, $\epsilon_t$=0.5).

In this case, the circular tooth top and bottom profiles are completely defined, unlike in the Maglott patent, by symmetry conditions, assuming that the center of the top and bottom circles belongs to the pitch circle, and also defining the two extreme points of the profile (the extreme points identified by the involute profile of the active tooth flank with $\epsilon_t$=0.5). However, since the bottom and top profiles are circular arcs with the same radius, these profiles can cause interference and failure because of manufacturing tolerance restrictions.

As in the Maglott patent, the Hitosi patent gives no information about the ideal value of the pressure angle of the active involute profile, the number of teeth or suitable solutions for balancing axial thrusts; moreover, no information is given on the analytical definition of alternative profiles to the involute profile for the tooth flanks.

U.S. Pat. No. 3,209,611 (Hitosi) defines the criteria to determine the number of teeth of a pump, assuming a contact ratio $\epsilon_t$=0.5 of the active flanks and tooth top and bottom profiles being circular segments, and also showing that the minimum number of teeth is $z_{min}$=3. This patent assumes that the use of elliptical profiles are used to define the tooth flank. However, said profiles are not conjugate profiles and the uniformity of motion transmission can not, therefore, be guaranteed.

Patent EP 1.371.848 (Morselli) defines a series of profiles by means of coordinates of points shown in tables, with number of teeth z=5, 6, 7, 8, 9, 10. The analytical definition of the profile curves is obtained by interpolation of the points by means of natural splines. The toothed profile of the rotor is helical with helical contact ratio $\epsilon_\beta$, which equals 1.0, as in Hitosi. However, the profile obtained by interpolation does not guarantee that the meshing profiles are conjugate profiles, or the non-encapsulation condition, thus resulting in a theoretical profile that does not ensure it can operate correctly. Moreover, the high profile oscillations obtained by means of interpolation make the theoretical profile impossible to construct.

Patent EP1.132.618 (Morselli) concerns generic profiles without encapsulation, with the helical contact ratio $\epsilon_\beta$ basically equal to one, the number of teeth equal to 7 and a solution for compensation of axial thrusts. However, there are no indications about the type of profile and the value of the transverse contact ratio, whereas the adoption of helical contact ratio $\epsilon_\beta$=1 and the value z=7 of the number of teeth are already mentioned in the prior technical literature and the compensation system of the axial thrusts coincides with the one disclosed in U.S. Pat. No. 3,658,452 (Yasuo Kita).

The purpose of the present invention is to eliminate the drawbacks of the prior techniques, by defining a toothed profile for rotors of positive displacement gear pumps, characterised by high-efficiency, noiseless operating conditions and high specific displacement.

Another purpose of the present invention is the analytical definition of a toothed profile that works and can be easily manufactured.

These purposes are achieved by the present invention, whose features are described in the independent claim 1.

Advantageous embodiments are disclosed in the dependent claims.

Additional characteristics of the invention will appear evident from the following detailed description, which refers to merely illustrative, not limiting embodiments, illustrated in the enclosed drawings, wherein.

Figure 10A:
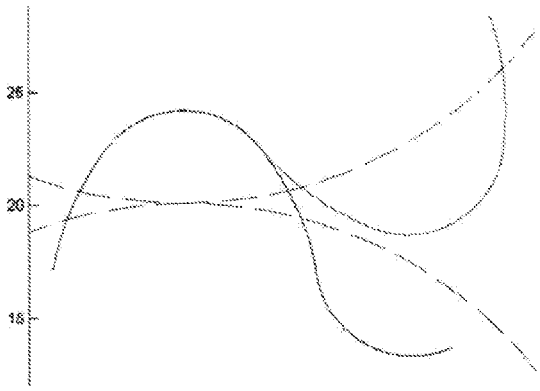
Figure 10B:
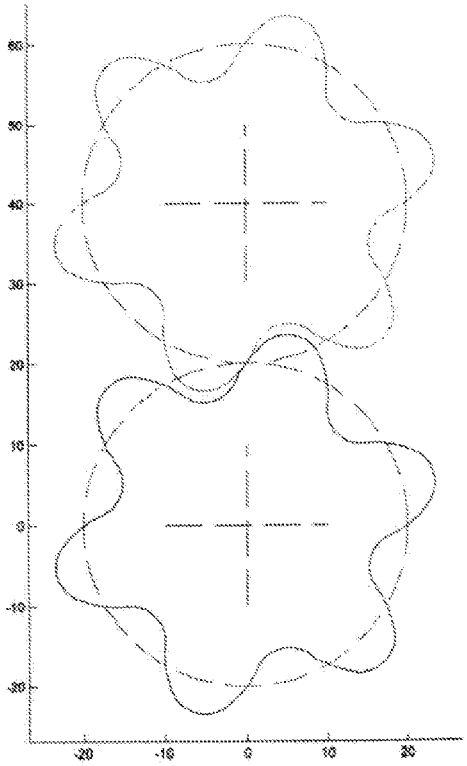
Figure 11A:
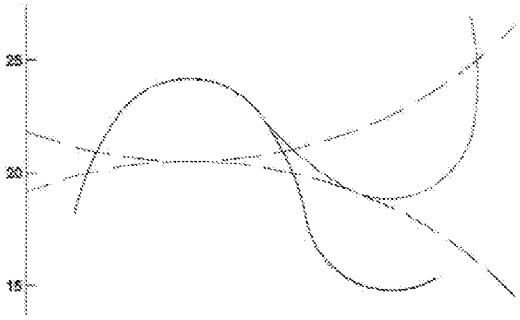
Figure 11B:
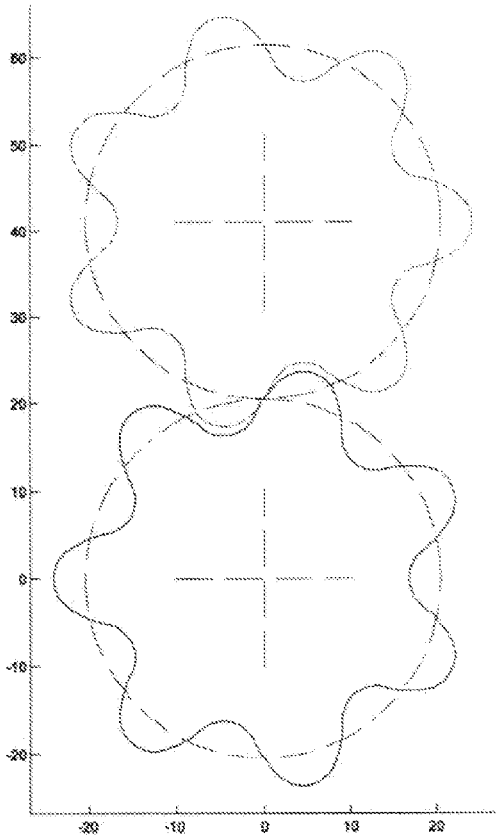
Figure 12A:
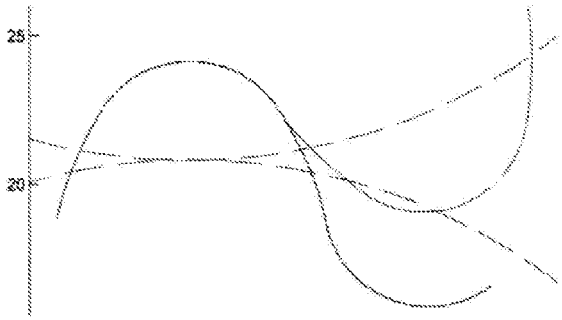
Figure 12B:
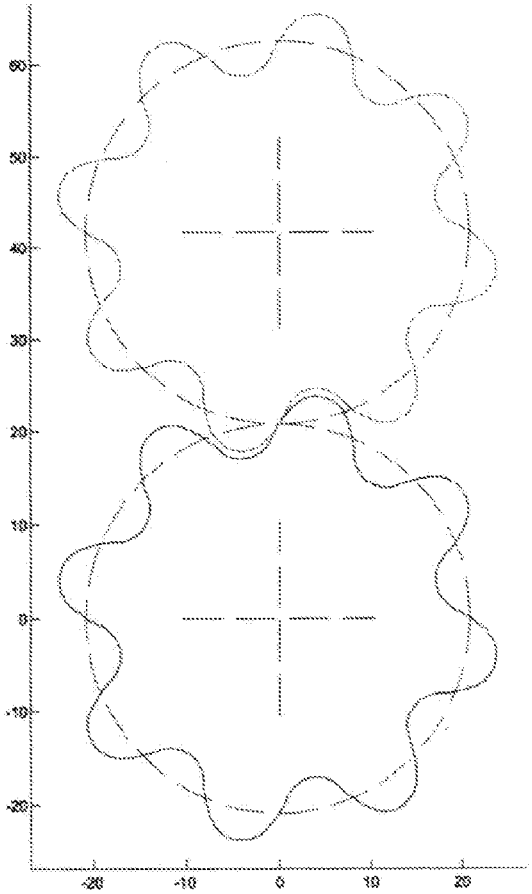
Figure 13:
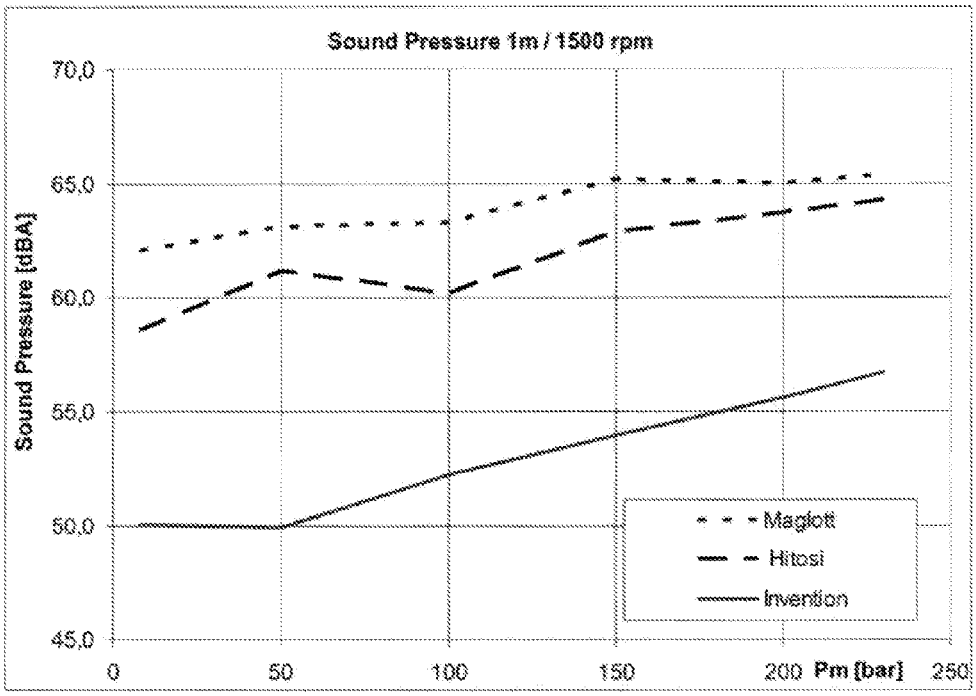
Figure 14:
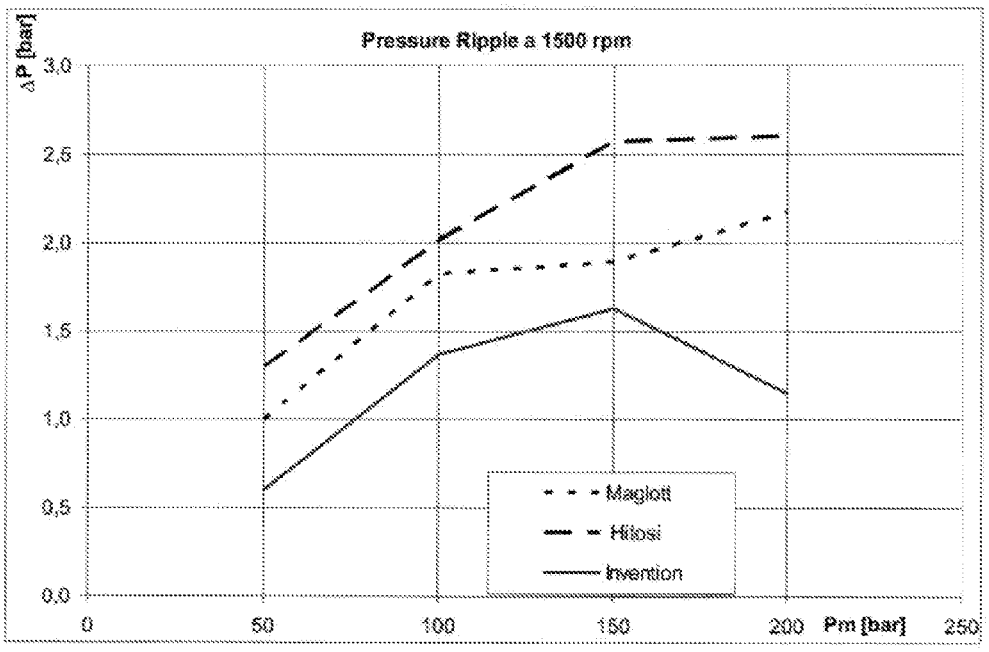

FIGS. 10*a* and 10*b* show the profile of a tooth and the gear of a first embodiment of the invention;

FIGS. 11*a* and 11*b* respectively show the profile of a tooth and the gear of a second embodiment of the invention;

FIGS. 12*a* and 12*b* respectively show the profile of a tooth and the gear of a third embodiment of the invention;

FIG. 13 is a chart showing a comparison of the noise performance (sound pressure) between a gear pump according to the present invention and two gear pumps according to prior technique; and FIG. 14 is a chart showing a comparison of pressure peak values (sound pressure) between a gear pump according to the present invention and two gear pumps according to prior technique;

FIGS. 15*a-c* are views of a pair of intermeshing profiles defined according to the precepts of U.S. Pat. No. 2,159,744 (Maglott) in some kinematic operating configurations;

FIG. 16 is a view of a pair of intermeshing profiles defined according to the precepts of U.S. Pat. No. 3,209,611 (Hitosi) in a specific kinematic operating configuration;

FIGS. 17*a-c* show the surface wear in the active flank surfaces of the rotors defined according to U.S. Pat. No. 2,159,744 (Maglott), U.S. Pat. No. 3,209,611 (Hitosi) and the present invention, at the end of a typical working cycle, corresponding to the end-of-life condition of a pump.

The applicant started from the precepts of U.S. Pat. No. 2,159,744 (Maglott) and designed a toothed profile for rotors of a positive displacement external gear pump, with:

an inactive tooth top profile, an inactive tooth bottom profile, an active right-handed tooth flank profile and an active left-handed flank profile.

The active right and left-handed flank profiles are involute stub-tooth profiles. The inactive top and bottom tooth profiles are defined by circular arcs.

Maglott suggests using transverse contact ratio $\epsilon_t$=0.5 and helical contact ratio $\epsilon_\beta$=0.5 to obtain motion continuity ($\epsilon=\epsilon_t+\epsilon_\beta\geq 1$); he indicates that the active right and left-handed flank profiles are involute profiles and also suggests that the positions of the centre of the arcs of circle for the tooth top and bottom profiles are respectively positioned above and below the pitch circle. However, the transverse pressure angle $\alpha_t$ associated with involute profiles is not indicated, being assumed to be equal to the standardised value $\alpha_t$=20° used by the various international standards (ISO; DIN; AGMA), and the position (i.e. the radial displacement $\Delta r_{t,p}$ with respect to the pitch curve) of the centre of the inactive tooth top and bottom profiles is not specified. The arbitrary choice of the position of these centres generally results in non-working profiles due to the interference of these profiles during meshing; moreover, the total profile resulting from the union of tooth bottom, flank and tooth top profiles is generally characterised by discontinuity of the tangent to the profile (cusp) at the extreme points of bottom, flank and top profiles, with negative consequences on motion regularity and noise emission during normal operation. FIGS. 15*a-c* are views of an example relative to a pair of profiles according to the precepts of U.S. Pat. No. 2,159,744 (Maglott) in some kinematic operating configurations: the cusps in the bottom-flank and flank-top couplings are evident, and the profile interference is shown in FIG. 15*b*. FIG. 15*c* shows the coincidence of tooth top and bottom profiles in a specific kinematic operating configuration (rotation $\theta=0.25*2\pi/z$ equal to one fourth of the angular pitch starting from the configuration of FIG. 15*a* in the flank contact in the centre of instantaneous rotation): according to the manufacturing technology used, the working errors of the profile may result in local interference, thus affecting the noise level of the application, the surface wear and the duration of the application. The geometrical parameters of the example shown in FIGS. 15*a-c* are the following:

z=10, number of teeth;

$\alpha_t$=20°, involute transversal pressure angle;

d=40 mm, involute pitch diameter;

$\Delta r_t=\Delta r_p$=0.6 mm, deviation of tooth top and bottom profile centres with respect to pitch circle;

$\epsilon_t$=0.5, transverse contact ratio;

$\epsilon_\beta$=0.5, helix contact ratio.

The design indications from the Hitosi (U.S. Pat. No. 3,209,611) do not provide a solution to this problem. Hitosi suggests using transverse contact ratio $\epsilon_t$=0.5 and helical contact ratio $\epsilon_\beta$=1 to respect motion continuity ($\epsilon=\epsilon_t+\epsilon_\beta=1.5\leq 1$). He indicates that the active right and left-handed flank profiles are involute profiles (claim 1) and also suggests that the positions of the centre of the circular arcs for the tooth top and bottom are situated in the pitch curve. Unlike Maglott, Hitosi univocally defines the position of the centres of the arcs of circle for the inactive tooth top and bottom profiles, but the theoretical coincidence of the curve of the bottom and top profiles during meshing may result in irregular operating conditions and noise, since profile interference may occur because of manufacturing errors associated with the technological working quality adopted. FIG. 16 shows an example of a pair of profiles defined according to the precepts of U.S. Pat. No. 3,209,611 (Hitosi) in the kinematic operating configuration for a rotation equal to one fourth of the angular pitch starting from the flank contact configuration in the centre of instantaneous rotation. The geometrical parameters of the example shown in FIG. 16 are as follows:

z=10, number of teeth;

$\alpha_t$=20°, involute transversal pressure angle;

d=40 mm, involute pitch diameter;

$\Delta r_t=\Delta r_p$=0 mm, deviation of tooth top and bottom profile centres with respect to pitch circle;

$\epsilon_t$=0.5, transverse contact ratio;

$\epsilon_\beta$=1.0, helical contact ratio.

The applicant considered it important to choose a transverse contact ratio ($\epsilon_t$) lower than 0.5 to guarantee absence of trapped oil volume and helical contact ratio $\epsilon_\beta$ suitable to guarantee motion continuity and operation regularity ($\epsilon=\epsilon_t+\epsilon_\beta>1$) and to minimise operating axial thrusts ($\epsilon_\beta<1$).

The first technical problem solved by the present invention therefore concerned finding the centre of the arcs of circles of the inactive top and bottom profiles, the radius of these profiles being univocally defined by the position of the extreme points of the flank profiles, which are in turn defined by the choice of $\epsilon_t$ and the transversal involute pressure angle of $\alpha_t$. The choice of the position of the centre of these profiles must be such to ensure the absence of interference of the profiles during meshing and a good geometrical continuity condition of the tooth profile (bottom-flank-top) in order to ensure regular noiseless operating conditions.

This technical problem was solved with the following algorithm.

The tooth flank profiles are involute profiles, and therefore the parametric equations of a point $P_{ev}$ belonging to an involute curve are shown below:

$$P_{ev}(\theta)=\begin{Bmatrix} R\cdot(\sin(\theta)-\theta\cdot\cos(\alpha_t)\cdot\cos(\alpha_t+\theta)) \\ R\cdot((\cos(\theta)-1.)+\theta\cdot\cos(\alpha_t)\cdot\sin(\alpha_t+\theta)) \end{Bmatrix} \quad (1)$$

wherein

R is the radius of the pitch curve, $\alpha_t$ is the transversal pressure angle, and $$\theta\in\left[-0.5*\varepsilon_t\cdot\frac{2\pi}{z},\ 0.5*\varepsilon_t\cdot\frac{2\pi}{z}\right]$$

is the involute construction angle (rolling angle of the involute line axis on the base circle with radius $R_b=R\cdot\cos(\alpha_t)$).

The tooth top and bottom profiles are circular segments; therefore the parametric equations of a point $P_{f,t}$ belonging to bottom (f) and top (t) circles are shown below:

$$P_{f,t}(\varphi) = O_{f,t} + \begin{Bmatrix} r_{f,t} \cdot \cos(\varphi) \\ r_{f,t} \cdot \sin(\varphi) \end{Bmatrix} \tag{2}$$

wherein the angle $\phi \in [\phi_{min}, \phi_{max}]$ and $\phi_{min}, \phi_{max}$ are defined by the known position of extreme points $P' = (P'_x, P'_y)$, $P'' = (P''_x, P''_y)$ of the circular segments:

$$\begin{cases} \varphi_{min} = \operatorname{atan}\left(\dfrac{(P'_y)_{f,t} - (O_y)_{f,t}}{(P'_x)_{f,t} - (O_x)_{f,t}}\right) \\ \varphi_{max} = \operatorname{atan}\left(\dfrac{(P''_y)_{f,t} - (O_y)_{f,t}}{(P''_x)_{f,t} - (O_x)_{f,t}}\right) \end{cases} \tag{3}$$

The top and bottom circles have different centres and different radiuses of curvature (the tooth top radius is lower than the tooth bottom radius). The top circle centre is positioned below the pitch circle, whereas the bottom circle centre is positioned above the pitch curve, in contrast with the opposite indications contained in U.S. Pat. No. 2,159,744 (Maglott).

Figure 1:
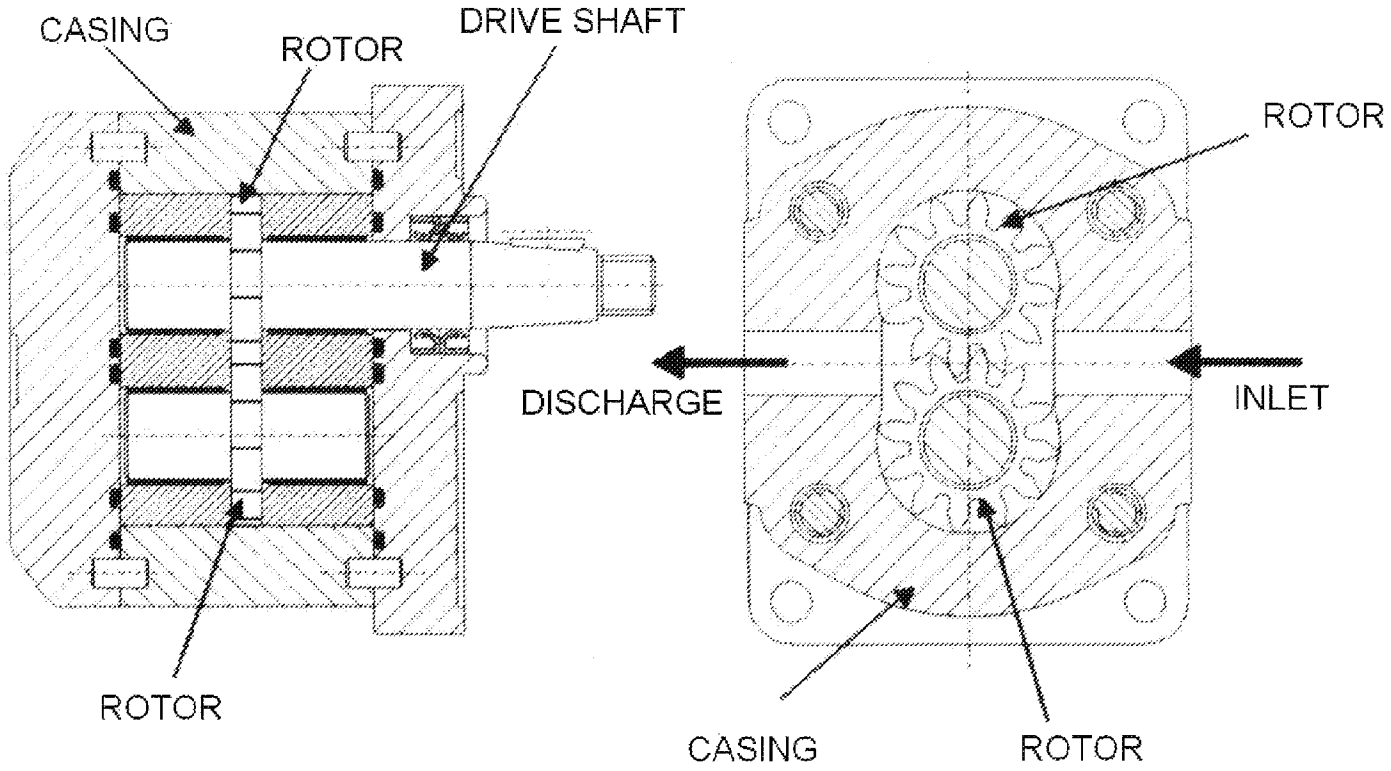
FIG. 1 PRIOR ART
FIG. 1 is a general view of a gear pump according to prior technique.
Figure 2:
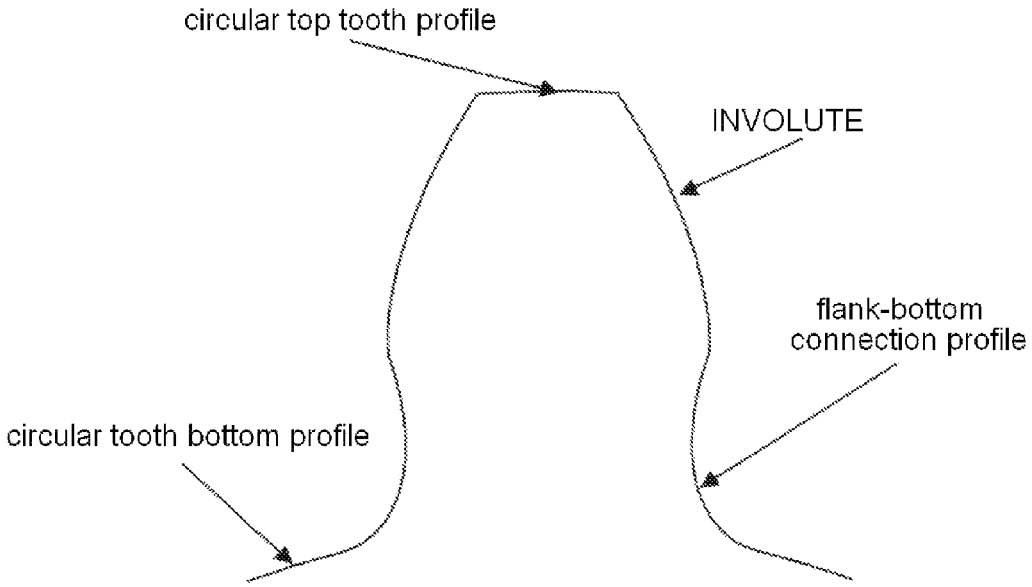
FIG. 2 PRIOR ART
FIG. 2 is a view of a traditional toothed profile of a gear pump according to prior technique.
Figure 3:
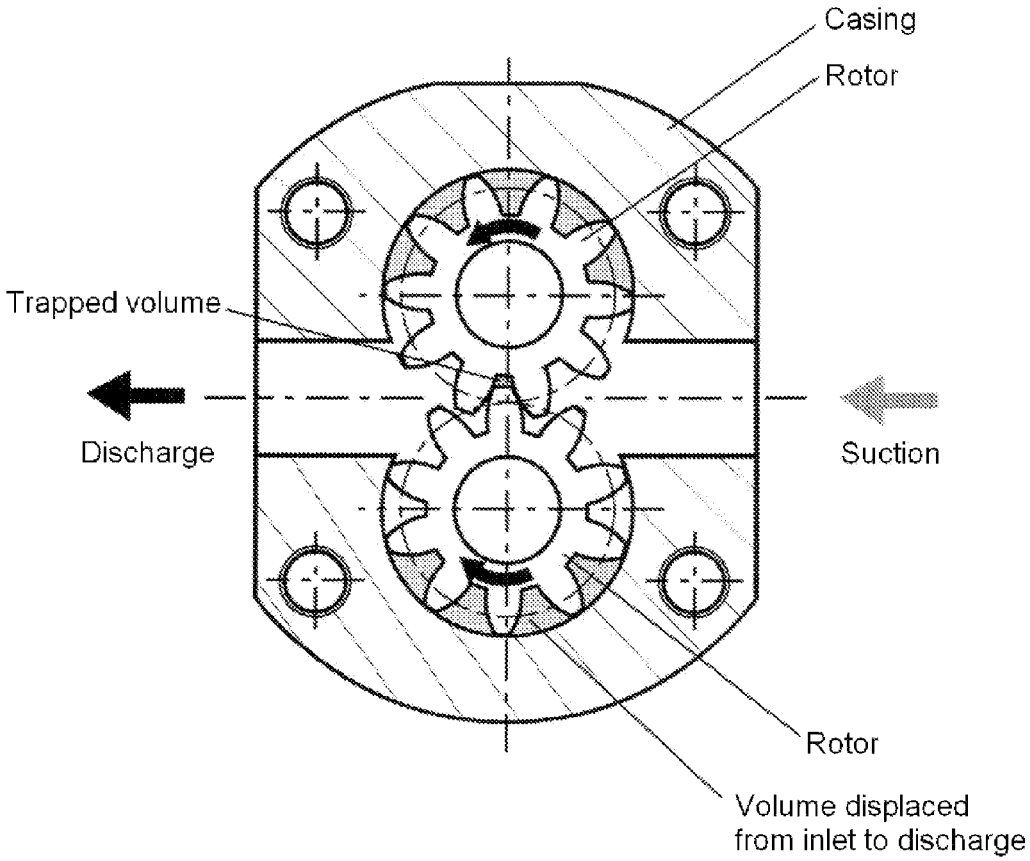
FIG. 3 PRIOR ART
FIG. 3 is a diagrammatic view of a gear pump according to prior technique, which shows the volume of fluid trapped between the teeth of the rotors.
Figure 4:
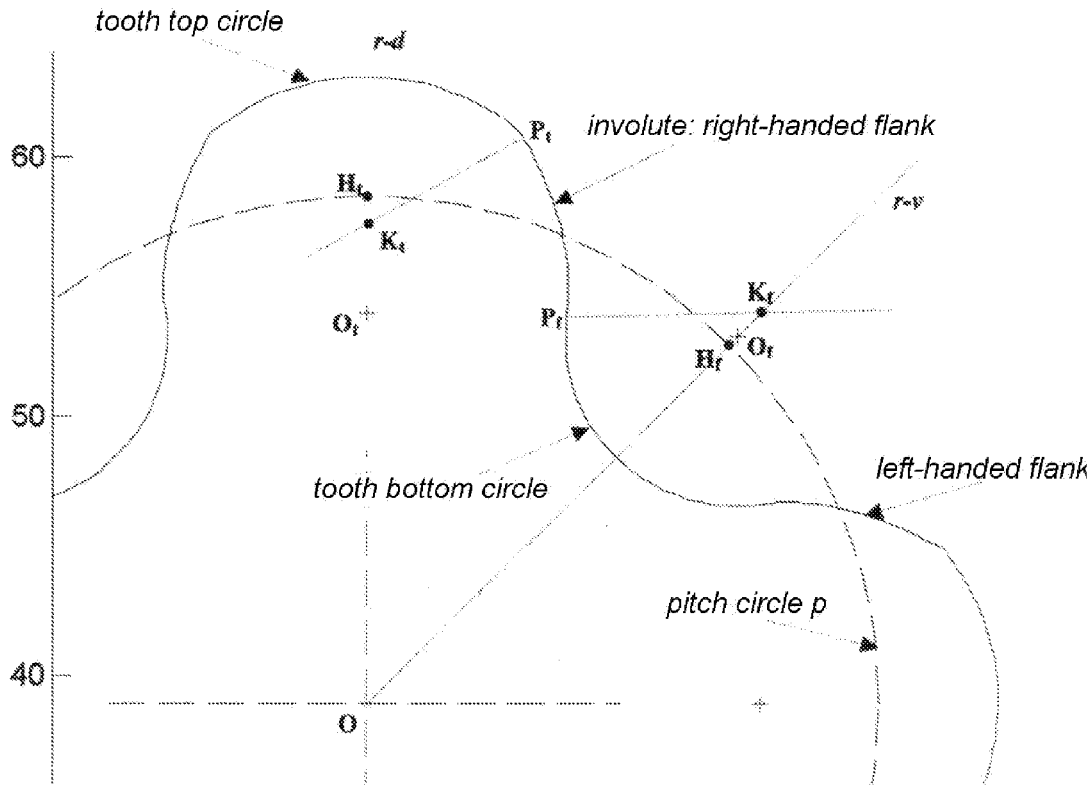
FIG. 4 is a view of a toothed profile with number of teeth z=4 with involute flank profile and circle tooth top and bottom profiles.

For illustration purposes, FIG. 4 shows a tooth profile with a number of teeth z=4. The teeth are defined by involute profiles in the right-handed flank and in the left-handed flank of the tooth, connected with corresponding arcs of circles in the tooth top and bottom.

O indicates the centre of the rotor where teeth are obtained and the pitch circle p is shown with a broken line.

The involute profile is defined between two extreme points $P_f$ and $P_t$.

The arcs of circle that correspond to the bottom and top profile have respective centres $O_f$, $O_t$ and respective radiuses $r_f$, $r_t$.

A point $K_f$ is identified from the intersection between the normal and the involute profile at the extreme point $P_f$ of the involute segment in proximity to the beginning of the root section and the radial direction r-v of middle line of the space between two adjacent teeth.

Likewise, a point $K_t$ is identified on the tooth from the intersection between the normal and the involute profile at the extreme point $P_t$ of the involute segment in proximity to the beginning of the top section and the radial direction r-d of middle line of the tooth.

If the transverse contact ratio $\epsilon_t$=0.5, then $K_f \equiv H_f$ and $K_t \equiv H_t$, where points $H_f$, $H_t$ belong respectively to the intersection between the pitch circle p and the straight lines r-v and r-d, and $|P_t-H_t|=|P_f-H_f|$, whereas generally $|P_t-K_t| \neq |P_f-K_f|$.

Given $\Delta R = 0.5*(|H_t-K_t|+|H_f-K_f|)$, the centre of the root circle is $O_f$, and the radius of the circle is $r_f$:

$$\begin{cases} O_f = H_f + (H_f - O) \cdot \dfrac{\Delta R}{|H_f - O|} \\ r_f = |P_f - O_f| \end{cases} \tag{4}$$

whereas the centre of the top circle $O_t$ and the radius of the top circle $r_t$ are identified by:

$$\begin{cases} O_t = H_t + (O - H_t) \cdot \dfrac{\zeta \cdot \Delta R}{|H_t - O|} \\ r_t = |P_t - O_t| \end{cases} \tag{5}$$

where $\zeta$=[1.1÷1.6] is a non-dimensional coefficient

The value of the parameter $\zeta$ must guarantee non interference between the top and bottom profiles ($\zeta$>1) and minimise the sealed pocket generated between top and bottom in the various kinematic operating configurations ($\zeta\downarrow$). The tooth profile (left handed flank-top-right handed flank-bottom) is class $C^0$ continuous, with discontinuity of the tangent in the conjunction between flank and tooth top.

After finding the equations to build the arcs of circle of the inactive top and bottom profiles, the applicant performed a series of experimental tests to find the ideal values of all the parameters that identify a toothed profile with helical teeth.

Maglott suggests using helical contact ratio ($\epsilon_\beta$) equal to 0.5, whereas Hitosi suggests using helical contact ratio ($\epsilon_\beta$) equal to 1; the applicant therefore decided to perform experimental tests in the range from 0.5 to 1 to guarantee motion continuity, minimise axial thrusts and to also guarantee insulation between suction and discharge chambers with a minimum value of teeth.

In order to increase pump displacement and delivery, the applicant carried out experimental tests with gears having a number of teeth lower than 10.

Maglott gives no precepts about the transversal pressure angle ($\alpha_t$) that characterises the involute profile. The reference standards show a standard value of 20° for the transversal pressure angle ($\alpha_t$). However, in order to maximise the extension of the tooth active profile, reduce the profile wear and increase the device life, the applicant decided to perform experimental tests with a transversal pressure angle ($\alpha_t$) higher than 20°.

Once the initial range of parameters was decided, the applicant performed experimental tests on gears. Four characteristics were mainly evaluated during the experimental tests: reduction of noise, reduction of overpressure peaks in discharge, wear and surface quality at end-of-life conditions.

The parameters that mainly affected noise reduction and pressure ripple peak reduction in discharge were transverse contact ratio ($\epsilon_t$) and helical contact ratio ($\epsilon_\beta$). In particular, for $\epsilon_t$=[0.4÷0.45] and simultaneously $\epsilon_\beta$=[0.60÷0.85], the applicant surprisingly found that noise reduction and overpressure peak reduction were considerably higher than the values obtained outside of these ranges.

The choice of the pressure angle value $\alpha_t$ mainly affected the surface wear conditions of the teeth, and secondarily the noise reduction over time was also highly affected by the surface quality of the rotor teeth. Surprisingly, the noise reduction and overpressure peak reduction additionally improved when using a number of teeth z=[6÷8] and a transversal pressure angle $\alpha_t$=[27°÷40°]. These values of number of teeth (z) and transversal pressure $\alpha_t$=[27°÷40°] made it possible to obtain the best compromise between noise reduction, overpressure peak reduction, specific displacement increase and wear minimisation.

The following three tables show the parameters of three pumps with toothed profiles according to the indications of Maglott, Hitosi and the present invention.

| Maglott | |
|---|---|
| Number of teeth Z = | 7 |
| Transverse contact ratio $\epsilon_t$ = | 0.50 |
| Helical contact ratio $\epsilon_\beta$ = | 0.50 |
| Pressure angle $\alpha_t$ = | 25.00 [°] |
| Top diameter Dt = | 37.20 [mm] |
| Ring width b = | 33.00 [mm] |
| Pump displacement = | 21 [$cm^3$/rev] |

| Hitosi | |
|---|---|
| Number of teeth Z = | 7 |
| Transverse contact ratio $\epsilon_t$ = | 0.50 |
| Helical contact ratio $\epsilon_\beta$ = | 1.00 |
| Pressure angle $\alpha_t$ = | 15.00 [°] |
| Top diameter Dt = | 37.20 [mm] |
| Ring width b = | 31.50 [mm] |
| Pump displacement = | 21 [$cm^3$/rev] |

| Invention | |
|---|---|
| Number of teeth Z = | 7 |
| Transverse contact ratio $\epsilon_t$ = | 0.45 |
| Helix contact ratio $\epsilon_\beta$ = | 0.80 |
| Pressure angle $\alpha$ = | 37.00 [°] |
| Top diameter Dt = | 37.20 [mm] |
| Ring width b = | 36.00 [mm] |
| Coefficient $\xi$ = | 1.25 |
| Pump displacement = | 21 [$cm^3$/rev] |

The three pumps have the same displacement, the same number of teeth and the same tooth top diameter.

During the experimental tests, the noise level (sound pressure) and pressure peaks (pressure ripple) were measured under the same reference conditions, when the discharge pressure (Pm) changed. The results are shown in the plots of FIGS. 13 and 14. The pump according to Maglott is shown with a dotted line, the pump according to Hitosi is shown with a broken line and the pump of the invention is shown with a full line. FIG. 17 shows the surfaces of the active flank of the three rotors at the end of a typical work cycle, corresponding to the pump end cycle condition (300 hours of continuous work, Pm=230 [bar] and n=1500 [rpm]). The rugosity of surfaces of the three rotors before the test was the same, Ra=$0.4*10^{-3}$ mm. At the end of the test, the average rugosity measurements made on the surface of the rotors according to the present invention show an average roughness value slightly higher than the initial one (Ra=$0.6*10^{-3}$ mm), whereas the measurements made on the rotors according to Maglott and Hitosi show much higher values (Ra=$6.4*10^{-3}$ mm for the Maglott profile; Ra=$5.2*10^{-3}$ mm for the Hitosi profile).

As is clearly shown in these figures, remarkable effects can be obtained. The pump made with toothed profiles according to the invention shows remarkably better performance in terms of noise level, pressure peaks and surface wear.

The synergic effect of the selected parameters guarantees that the profile for toothed rotors of external gear pumps according to the invention is characterised by noiseless operation, minimisation of vibrations and pressure ripples generated in operating conditions (using oil as the operating fluid and high pressure difference between suction and delivery, $\Delta p_{max}$=300 bar), at the beginning and end-of-life of the gear pump using said toothed profiles.

The adopted solutions make it possible to satisfy all of the given specifications and the choice of design parameters is such that opposite specifications can be optimised.

The following is a discussion of the advantages associated with the choice of design parameters.

The range of number of teeth z=[6÷8] makes it possible to increase the specific displacement and to obtain especially compact pumps with the same delivery, or to increase the delivery of a pump with a given volume. The minimum value z=6 is compatible with the involute profile requirements (the involute profile cannot extend below the base circle $R_b$, with radius equal to the radius of the pitch circle R for the cosine of the transversal pressure angle $\alpha_t$, $R_b=R\cdot\cos(\alpha_t)$) due to the reduced value of the profile contact ratio used ($\epsilon_t$=[0.4÷0.45]).

The following is an equation that identifies the relationship between transversal pressure angle $\alpha_t$, minimum number of teeth ($z_{min}$) and transverse contact ratio factor ($\epsilon_t$):

$$z_{min}=Int(\epsilon_t*\pi/\alpha_t) \quad (6)$$

where Int( ) is the rounding operator to the closest integer value higher or equal to the argument value.

For example, given $\alpha_t$=30°,$\epsilon_t$=0.45⇒ $z_{min}$=Int(2.7)=3.

The value of the transverse contact ratio is $\epsilon_t$=[0.4÷0.45] guarantees the absence of trapped volume, $\epsilon_t$ being <0.5. In addition, this value guarantees that the different profiles used to define the top and bottom profiles (circular segments with different radius and centre) do not create interference in the different kinematic operating configurations and the sealed pocket identified between top and bottom is minimal and such that the volumetric efficiency of the pump is maximised.

The helical contact ratio $\epsilon_\beta$=[0.6÷0.85] was chosen as considerably lower than one and such that motion continuity is guaranteed, since $\epsilon_t+\epsilon_\beta\geq 1$. This choice is associated with the minimum values of the parameter $\epsilon_\beta$ in order to minimise the axial thrusts and to guarantee the insulation between the suction and the discharge chambers, also in the case of low values of the number of teeth (z=6).

The active profile used to define the tooth flank is an involute circle profile. The tooth active profiles are conjugate profiles, guaranteeing uniformity of motion transmission. Moreover, this profile guarantees insensitivity to small centre-to-centre variations of the rotors due to constructive and assembly needs, as well as the high mechanical resistance to breakage and surface fatigue. The choice of a low transverse contact ratio $\epsilon_t$=[0.4÷0.45] of the involute profile, however, makes these involute profiles stub-tooth profiles.

Figure 5:
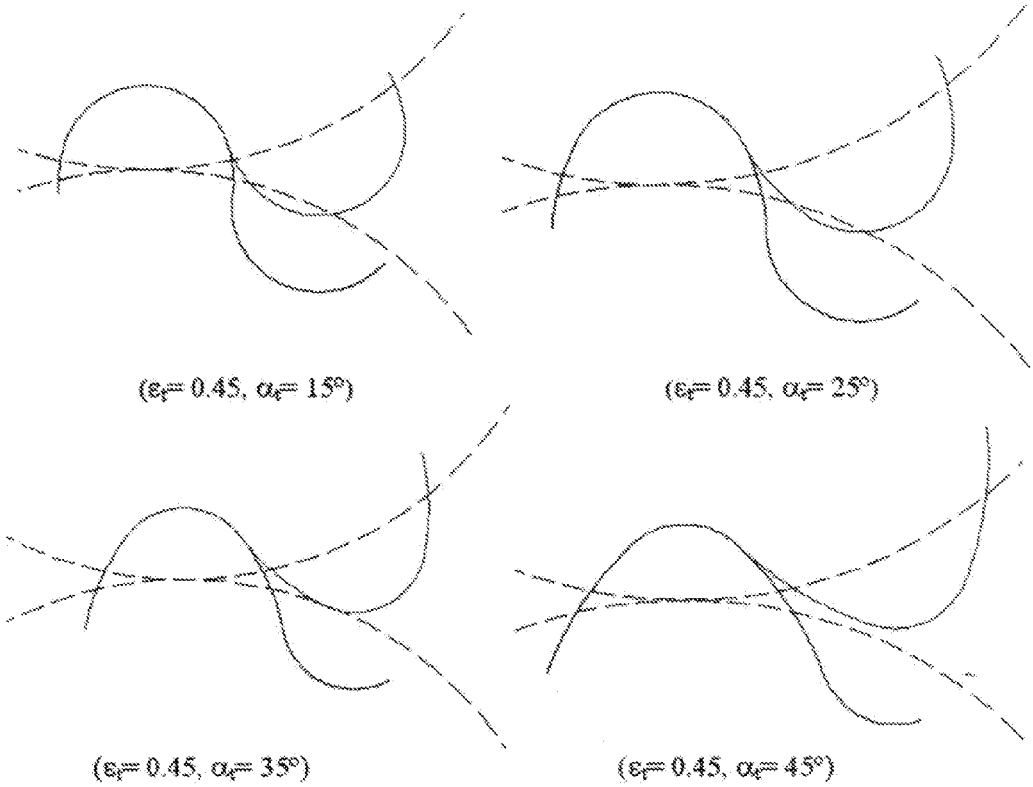
FIG. 5 is a view of some toothed profiles adopting different values of the involute pressure angle $\alpha_t$, with transverse contact ratio $\epsilon_t$=0.45.

To minimise the extension of the tooth active profile, in order to decrease the profile wear and increase the device life, a value of the transversal pressure angle $\alpha_t$=[27°÷40°], which is considerably higher than the normalised standard value $\alpha_t$=20°, was chosen. FIG. 5 is a view of some toothed profiles obtained with different values of $\alpha_t$, with $\epsilon_t$=0.45. As shown in FIG. 5, the best solution is obtained for $\alpha_t$=[27°÷40°].

Figure 6:
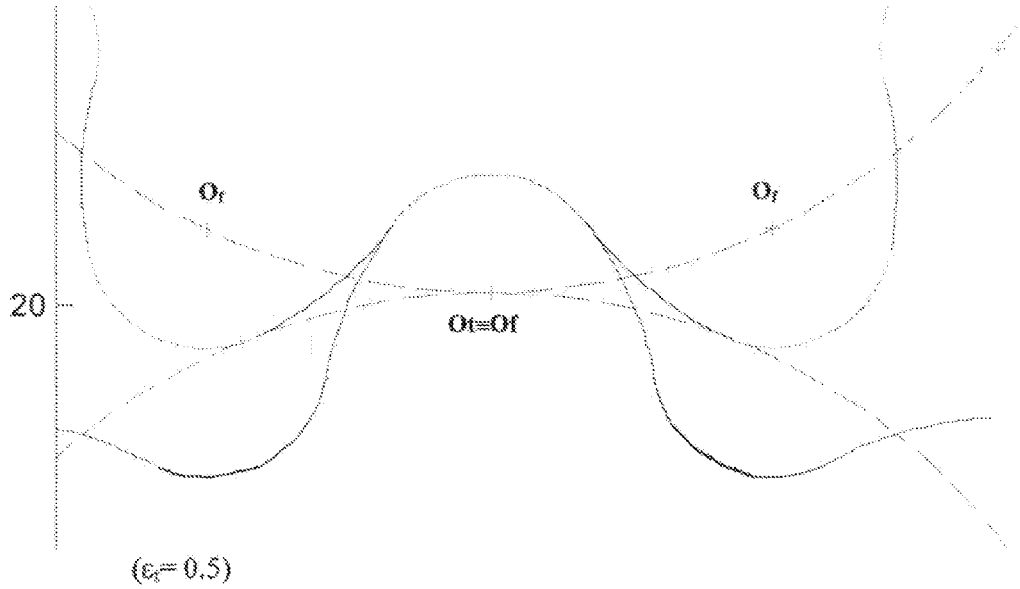
FIG. 6 is a view of a toothed profile with transverse contact ratio $\epsilon_t$=0.5.

The inactive top and bottom tooth profiles are circular segments. If the centre of these circles (theoretical centre $O_{t,f}$) belong to the pitch circle p and the involute profile extension is defined by $\epsilon_t$=0.5, the circular tooth top and bottom portions have the same radius and completely overlap with respect to some kinematic configurations, as shown in FIG. 6. However, such a theoretical profile can cause profile interference due to working tolerances, and the adoption of circular profiles with a different radius and a different position of the associated centre generally causes profile interference with respect to some kinematic operating configurations.

In the solution according to the invention, the choice of the extreme connection points ($P_t$ and $P_f$) of the top and bottom profiles with the involute flank profiles is defined by the condition $\epsilon_t[0.4 \div 0.45]$. The centre ($O_f$) of the root profile circle is univocally defined by the equation (4), whereas the centre ($O_t$) of the top profile circle is defined by the equation (5), with $\zeta>1$, in such a way that the top radius $r_t$ is generally higher than the bottom radius $r_f$.

Figure 7:
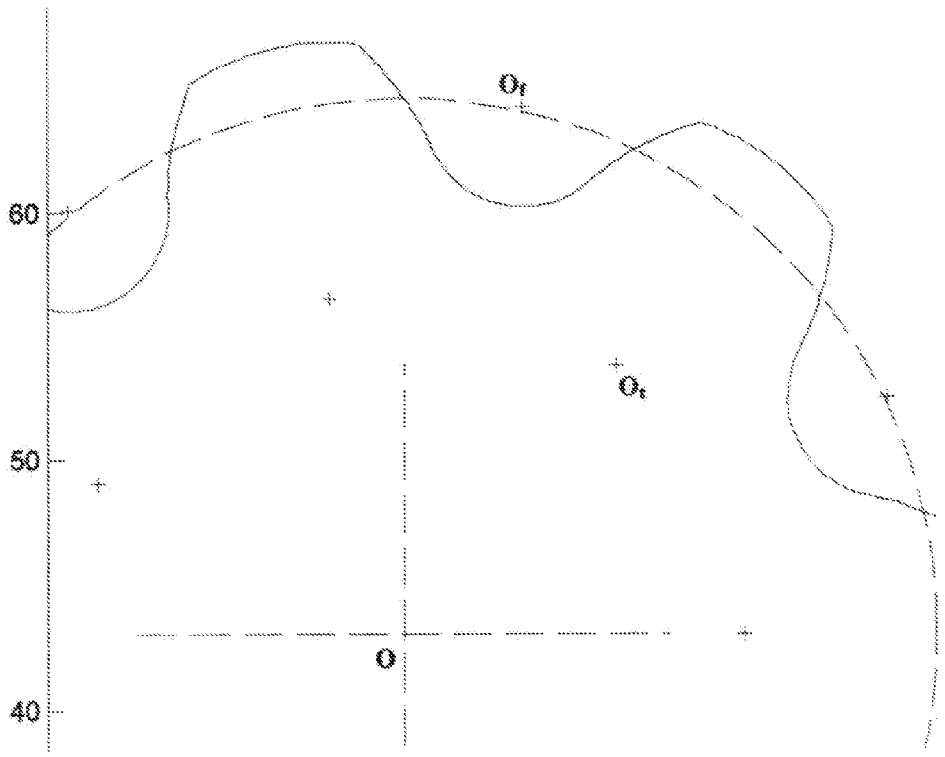
FIGS. 7-9 are views of three toothed profiles obtained with different values of the non-dimensional parameter $\zeta$=20, $\zeta$=5 and $\zeta$=1.25, related to the circle tooth top profile.

FIG. 7 shows a tooth profile wherein Z=7, $\epsilon_t$=0.4 and $\alpha_t$=35°, obtained in the extreme case in which $\zeta$=20. The $\zeta$ value is chosen according to the working quality associated with the realisation of this profile, and at the maximum value of tolerated sealed pocket between top and bottom profiles. The characteristic sealed pocket thickness h can be evaluated with the following equation:

$$h=r_f-r_t+(\zeta+1)\cdot\Delta R \tag{7}$$

According to the present invention, ideal values of the parameter are chosen, in particular $\zeta=[1.1 \div 1.6]$. This range of values guarantees that the non-interference condition is satisfied and the sealed pocket generated between the top and bottom in the different kinematic operating configurations is minimum and such that high volumetric efficiency values are guaranteed.

Figure 8:
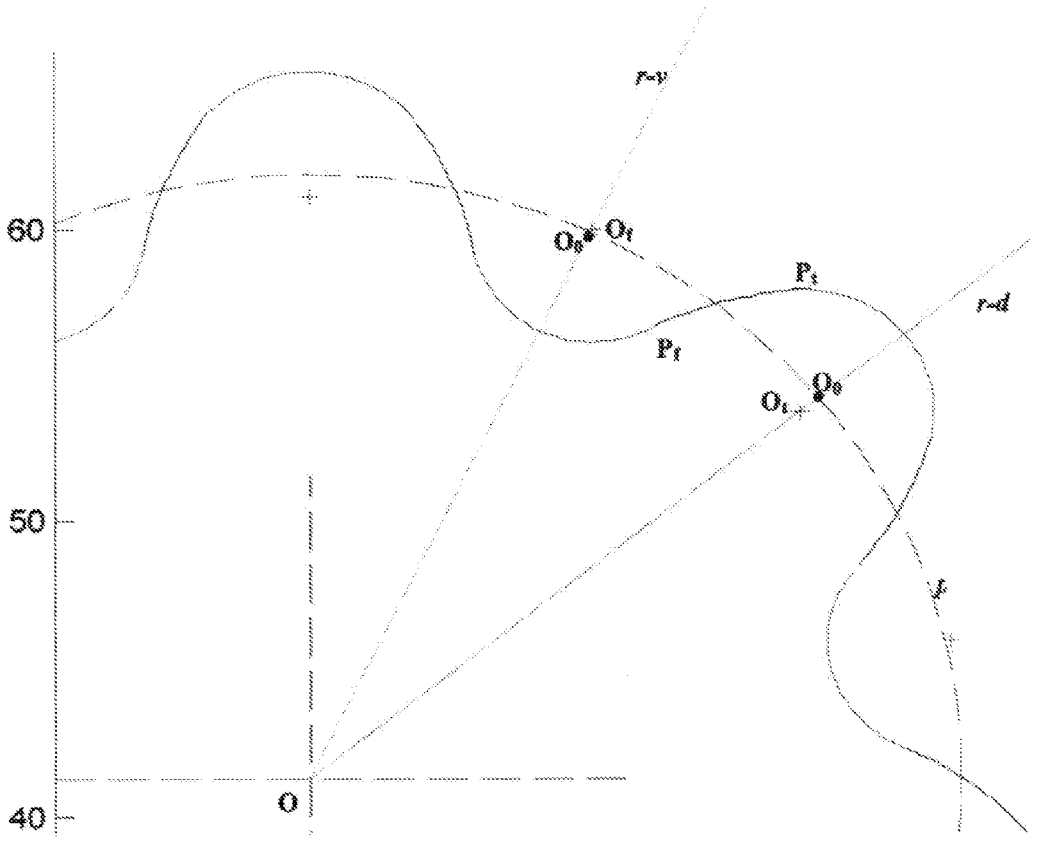
Figure 9:
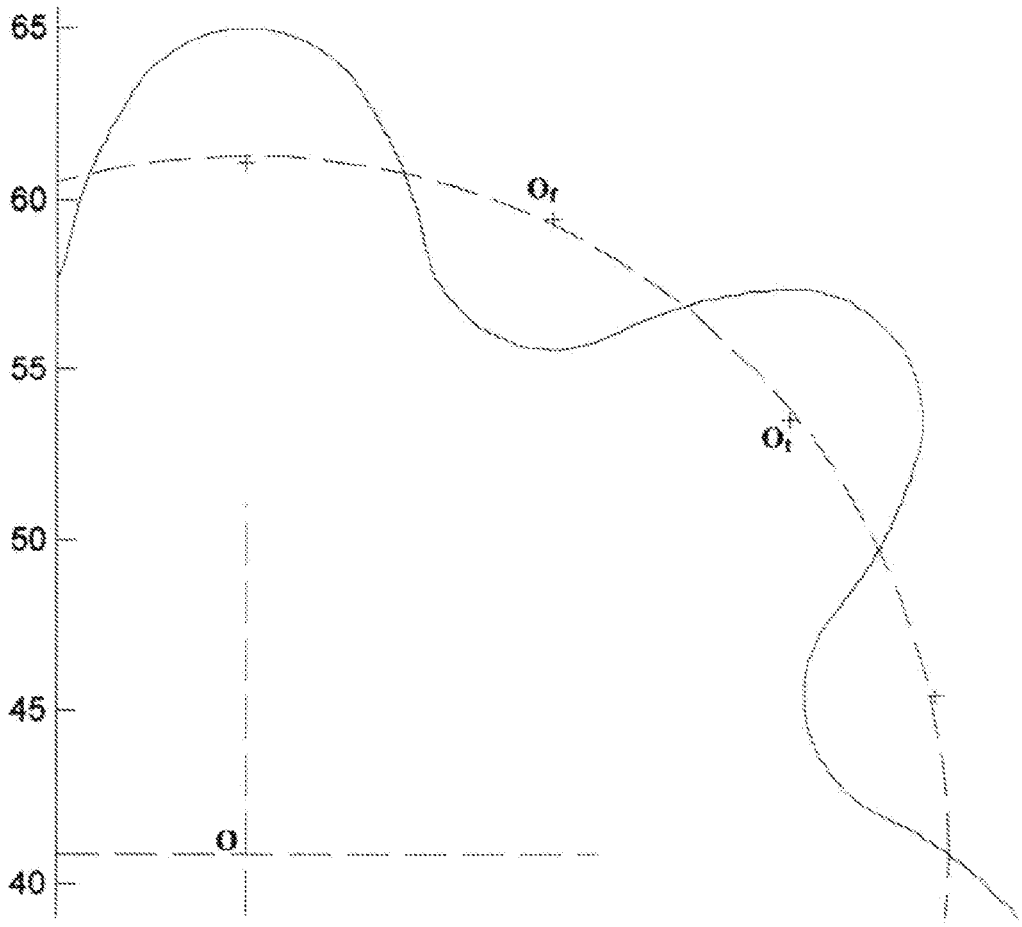

The tooth profile (left flank-top-right flank-bottom) is class $C^0$ continuous, with discontinuity of the tangent in the connection between flank and top and flank and bottom, as shown in the examples of FIG. 7 ($\zeta$=20), FIG. 8 ($\zeta$=5), and FIG. 9 ($\zeta$=1.28).

Discontinuity is minimal in the value range $\zeta=[1.1 \div 1.6]$, as shown in FIG. 9. In any case, discontinuity affects the inactive profile portion and therefore does not affect the correct motion transmission.

The following are the parameters and specifications of three examples of tooth profiles according to the invention, for the realisation of a pair of toothed wheels used in an external gear pump.

EXAMPLE 1

| | |
|---|---|
| z = 6; | number of teeth; |
| $\alpha_t$ = 37° | transversal pressure angle; |
| R = 20,048 mm | Pitch circle radius; |
| $\epsilon_t$ = 0.45 | transverse contact ratio; |
| $\epsilon_\beta$ = 0.80 | helix contact ratio; |
| $\zeta$ = 1.26 | non-dimensional factor for root profile definition; |
| L = 30 mm | tooth width. |

The following characteristic parameters of the gear and pump can be evaluated:

| | |
|---|---|
| $D_t$ = 2 * $R_t$ = 48.3 mm | Tip diameter; |
| a = 40,097 mm | gear centre distance; |
| $\alpha_n$ = 33.326° | normal pressure angle; |
| $\beta$ = 29.243° | helix angle; |
| $r_t$ = 4,331 mm | tooth top radius; |
| $r_f$ = 4,305 mm | tooth bottom radius; |
| V = 33,108 $cm^3$ | displacement; |

FIG. 10*a* shows the tooth profile obtained by using the aforesaid parameters and FIG. 10*b* shows the two gear rotors with this tooth profile.

EXAMPLE 2

| | |
|---|---|
| z = 7; | number of teeth; |
| $\alpha_t$ = 35° | transversal pressure angle; |
| R = 20,485 mm | Pitch circle radius; |
| $\epsilon_t$ = 0.43 | transverse contact ratio; |
| $\epsilon_\beta$ = 0.82 | helical contact ratio; |
| $\zeta$ = 1.2 | non-dimensional factor for root profile definition; |
| L = 30 mm | tooth width. |

The following characteristic parameters of the gear and pump can be evaluated:

| | |
|---|---|
| $D_t$ = 2 * $R_t$ = 48.3 mm | Tip diameter; |
| a = 40,969 mm | gear centre distance; |
| $\alpha_n$ = 32.032° | normal pressure angle; |
| $\beta$ = 26.683° | helix angle; |
| $r_t$ = 3,906 mm | tooth top radius; |
| $r_f$ = 3,886 mm | tooth bottom radius; |
| V = 29,989 $cm^3$ | displacement; |

FIG. 11*a* shows the tooth profile obtained with the parameters of example 2 and FIG. 11*b* shows the two gear rotors with this tooth profile.

EXAMPLE 3

| | |
|---|---|
| z = 8; | number of teeth; |
| $\alpha_t$ = 33° | transversal pressure angle; |
| R = 20,826 mm | pitch circle radius; |
| $\epsilon_t$ = 0.41 | transverse contact ratio; |
| $\epsilon_\beta$ = 0.84 | helical contact ratio; |
| $\zeta$ = 1.17 | non-dimensional factor for root profile definition; |
| L = 30 mm | tooth width. |

The following characteristic parametrs of the gear and pump can be evaluated:

| | |
|---|---|
| $D_t$ = 2 * $R_t$ = 48.3 mm | Tip diameter; |
| a = 41,653 mm | gear center distance; |
| $\beta$ = 24.607° | helix angle; |
| $\alpha_n$ = 30.559° | normal pressure angle; |
| $r_t$ = 3,566 mm | tooth top radius; |
| $r_f$ = 3,549 mm | tooth bottom radius; |
| V = 27,483 $cm^3$ | displacement; |

FIG. 12*a* shows the tooth profile obtained with the parameters of example 3 and FIG. 12*b* shows the two gear rotors with this tooth profile.

Many variations and modifications can be made to the present embodiments of the invention by an expert of the field, while still falling within the scope of the invention as disclosed in the attached claims.

The invention claimed is:

1. A tooth profile for rotors of a positive displacement gear pump with external helical teeth gear wheels, comprising:

an inactive tooth top profile, an inactive tooth bottom profile, an active right-handed tooth flank profile and an active left-handed flank profile, wherein said active right and left-handed tooth flank profiles are stub-tooth involute profiles and said inactive tooth top and bottom profiles are defined by circular arcs wherein the active stub-tooth involute profile has a transverse contact ratio or continuity ($\epsilon_t$) from 0.4 to 0.45, and the helical teeth gear has an helical contact ratio or continuity ($\epsilon_\beta$) from 0.6 to 0.85, said circular arches of inactive tooth top and bottom profiles have a centre ($O_f$, $O_t$) and radius ($r_f$, $r_t$) defined by the following equations:

$$\begin{cases} O_f = H_f + (H_f - O)\cdot\dfrac{\Delta R}{|H_f - O|} \\ r_f = |P_f - O_f| \end{cases}$$

and $$\begin{cases} O_t = H_t + (O - H_t)\cdot\dfrac{\zeta\cdot\Delta R}{|H_t - O|} \\ r_t = |P_t - O_t| \end{cases}$$

with ($\zeta$=[1.1÷1.6])

$$\Delta R = 0.5*(|H_t - K_t| + |H_f - K_f|)$$

wherein

O is the centre of the primitive circumference (p) of the gear;

$H_f$ is a point on the primitive circumference on the radial direction (r-v) of the centre line of the space between two contiguous teeth;

$P_f$ is a point at the end of the involute segment near the beginning of the tooth root section;

$K_f$ is a point identified by the intersection of the normal and the involute profile in point $P_f$ and the radial direction (r-v) of the centre line of the space between two contiguous teeth, $H_t$ is a point on the primitive circumference on the radial direction (r-v) of the centre line of the tooth;

$P_t$ is a point at the end of the involute segment near the beginning of the tooth top section;

$K_t$ is a point identified by the intersection between the normal and the involute profile in point $P_t$ of the segment and the radial direction (r-d) of the centre line of the tooth.

2. A tooth profile according to claim 1, wherein the rotor comprises a number of teeth (z) from 6 to 8.

3. A tooth profile according to claim 1 or 2, wherein said active stub-tooth involute profile has a transverse pressure angle ($\alpha_t$) from 27° to 40°.

4. A positive displacement pump with external teeth gears comprising two rotors with tooth profile according to claim 1.

* * * * *